US008417145B2

(12) United States Patent
Honda

(10) Patent No.: US 8,417,145 B2
(45) Date of Patent: Apr. 9, 2013

(54) PHOTORECEPTOR UNIT OF IMAGE FORMING APPARATUS

(75) Inventor: Shin Honda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 268 days.

(21) Appl. No.: 12/943,068

(22) Filed: Nov. 10, 2010

(65) Prior Publication Data

US 2011/0217071 A1 Sep. 8, 2011

(30) Foreign Application Priority Data

Mar. 8, 2010 (JP) ..... 2010-050093

(51) Int. Cl.
*G03G 21/18* (2006.01)

(52) U.S. Cl. ..... 399/111

(58) Field of Classification Search ..... 399/111, 399/110, 116, 107
See application file for complete search history.

(56) References Cited

U.S. PATENT DOCUMENTS 5,920,752 A * 7/1999 Karakama et al. ..... 399/111
5,943,528 A * 8/1999 Akutsu et al. ..... 399/110
2001/0055500 A1* 12/2001 Katakabe et al. ..... 399/111
2004/0234293 A1* 11/2004 Karakama et al. ..... 399/111

FOREIGN PATENT DOCUMENTS

JP 05-100506 A 4/1993
JP 2002-278416 A 9/2002
JP 2008-090121 A 4/2008
JP 2009-271287 A 11/2009

* cited by examiner

*Primary Examiner* — Susan Lee
(74) *Attorney, Agent, or Firm* — Sughrue Mion, PLLC

(57) ABSTRACT

A photoreceptor unit of an image forming apparatus includes an attachment body, a photoreceptor body, a first gripping portion, and a second gripping portion. The attachment body is attached to the image forming apparatus and is detachable from the image forming apparatus. The photoreceptor body is rotatably provided in the attachment body. The first gripping portion is provided in the attachment body. The second gripping portion is provided in the attachment body and is contactable with the photoreceptor body when the photoreceptor unit is gripped. The second gripping portion does not contact the photoreceptor body when the photoreceptor unit is attached to the image forming apparatus. The photoreceptor body is provided between the first gripping portion and the second gripping portion and is allow to be gripped by using the first gripping portion and the second gripping portion.

6 Claims, 8 Drawing Sheets

PHOTORECEPTOR UNIT OF IMAGE FORMING APPARATUS

CROSS-REFERENCE TO RELATED APPLICATIONS

This application is based upon and claims priority under 35 USC 119 from Japanese Patent Application No. 2010-050093, filed Mar. 8, 2010.

BACKGROUND

Technical Field

The present invention relates to a photoreceptor unit of an image forming apparatus.

SUMMARY OF THE INVENTION

According to an aspect of the invention, a photoreceptor unit of an image forming apparatus includes an attachment body, a photoreceptor body, a first gripping portion, and a second gripping portion. The attachment body is attached to the image forming apparatus and is detachable from the image forming apparatus. The photoreceptor body is rotatably provided in the attachment body. The first gripping portion is provided in the attachment body. The second gripping portion is provided in the attachment body and is contactable with the photoreceptor body when the photoreceptor unit is gripped. The second gripping portion does not contact the photoreceptor body when the photoreceptor unit is attached to the image forming apparatus. The photoreceptor body is provided between the first gripping portion and the second gripping portion and is allow to be gripped by using the first gripping portion and the second gripping portion.

BRIEF DESCRIPTION OF THE DRAWINGS

Exemplary embodiments of the invention will be described in detail based on the following figures, wherein.

DETAILED DESCRIPTION

An embodiment of the present invention will be hereinafter described with reference to the drawings.

(1) Basic Configuration and Operations of Printer

First, a basic configuration and operations of a printer (image forming apparatus) according to the embodiment will be described.

Figure 1:
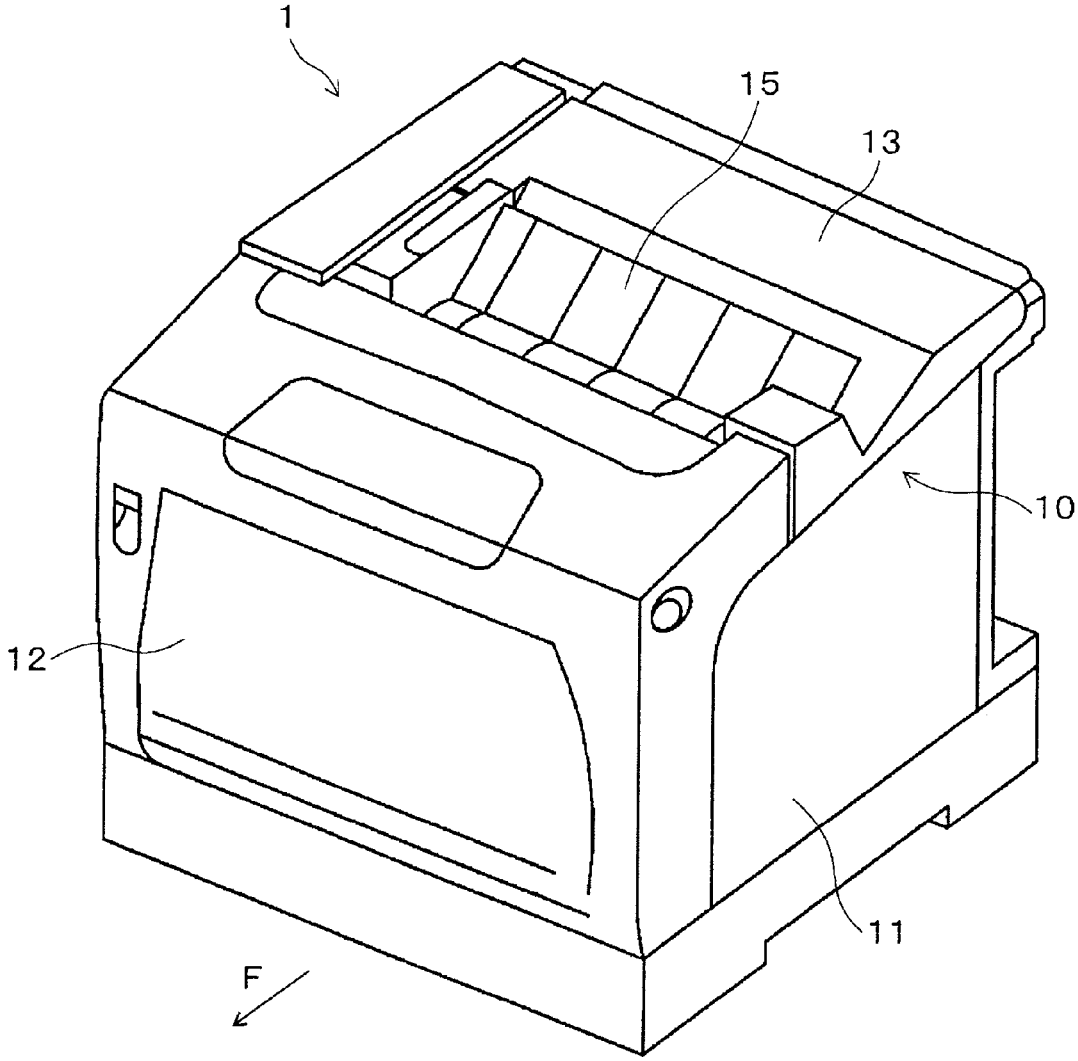
FIG. 1 is a perspective view showing an appearance of a printer according to an embodiment of the present invention.
Figure 2:
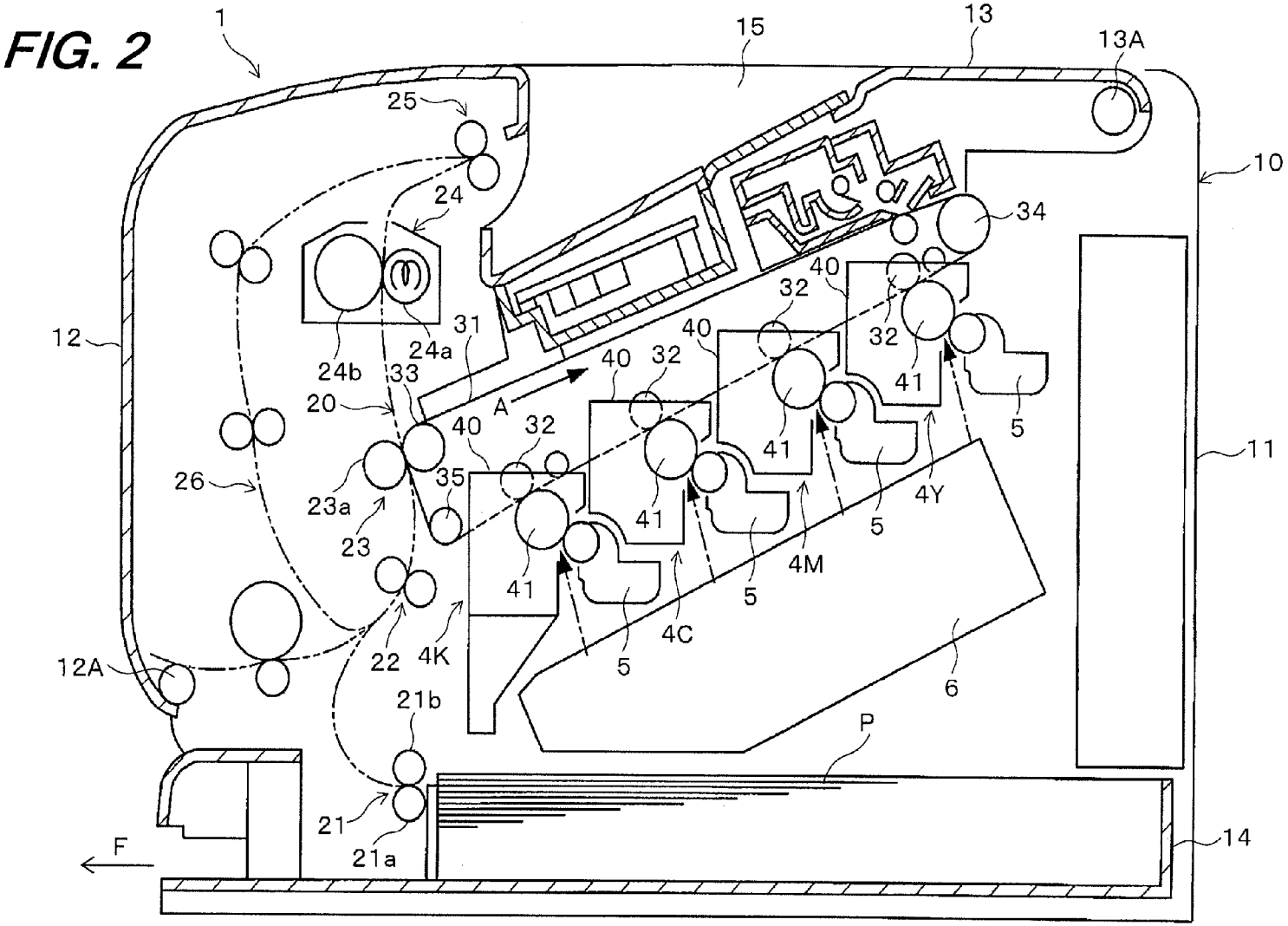
FIG. 2 is a side view showing the internal configuration of the printer (a front cover and a top cover are closed)
Figure 3:
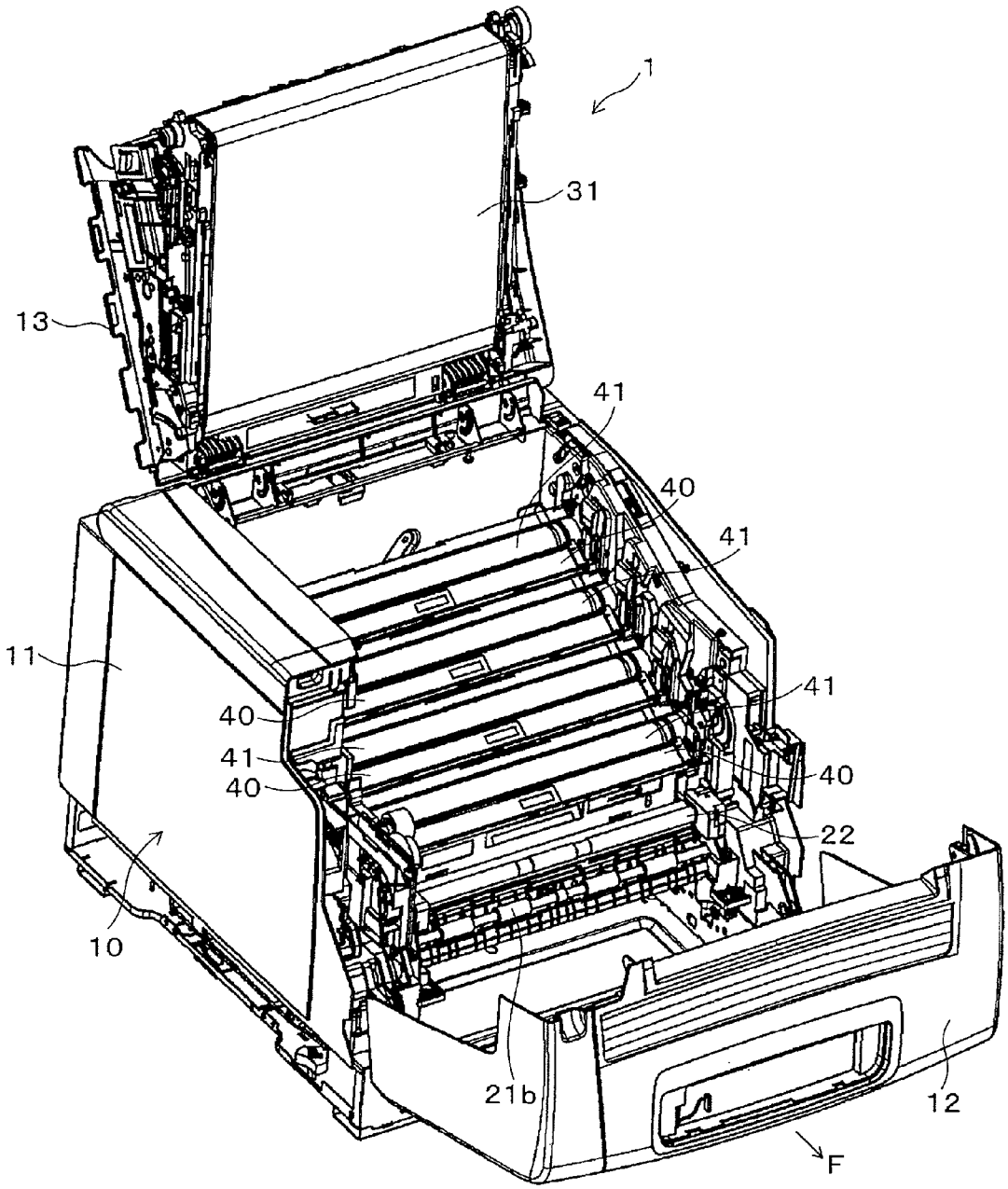
FIG. 3 is a perspective view showing an appearance of the printer in a state that the front cover and the top cover are opened.
Figure 4:
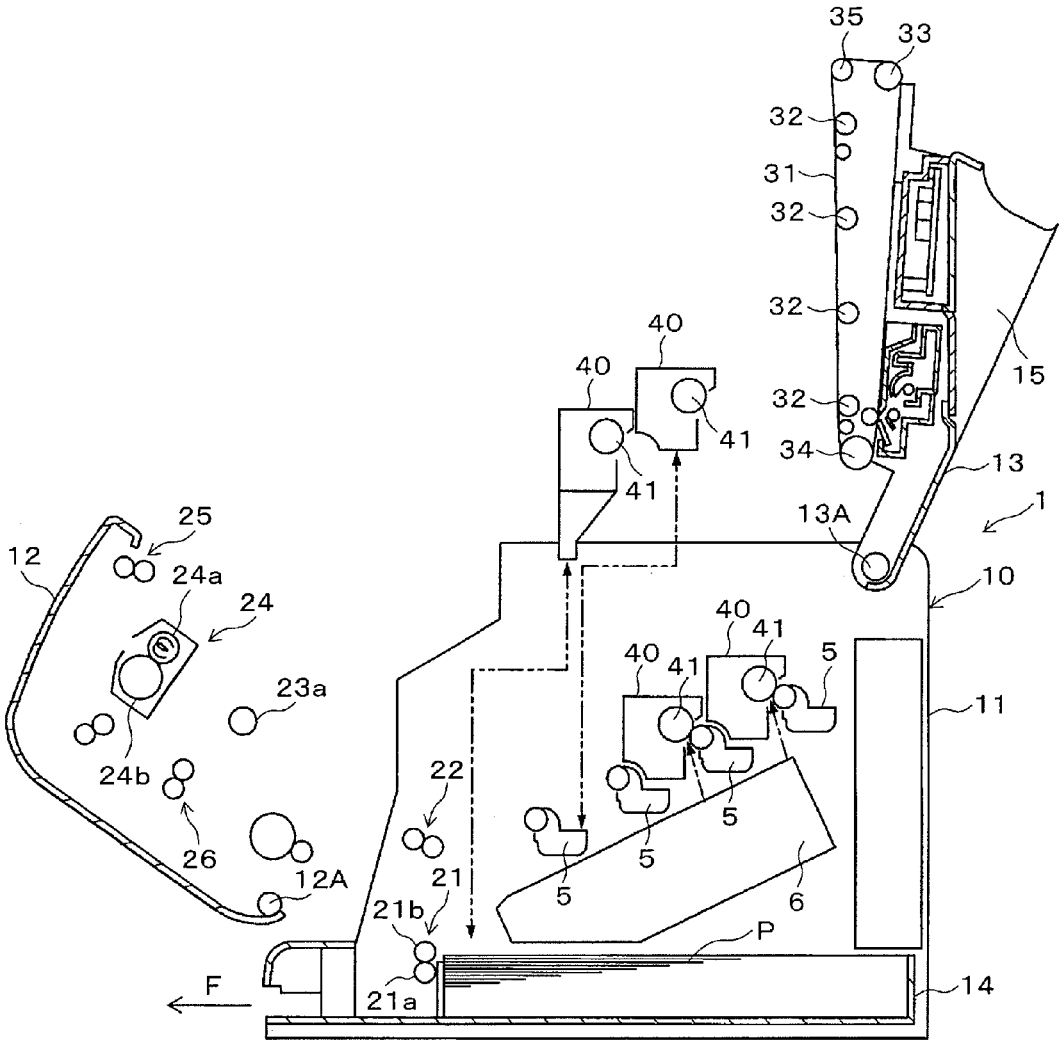
FIG. 4 is a side view showing the internal configuration of the printer (the front cover and the top cover are opened)

FIG. 1 shows an appearance of the printer 1 according to the embodiment, and FIG. 2 shows its internal configuration. In FIGS. 1 and 2, reference numeral 10 denotes an apparatus main body having a cabinet 11. As shown in FIGS. 3 and 4, the apparatus main body 10 has an opening that occupies a top portion and a front portion (in FIGS. 1-4, the front side is indicated by arrow F) and the opening is closed by a front cover 12 and a top cover 13. The front cover 12 serves to cover the front portion and a top-front portion of the apparatus main body 10 and has an inverted-L shape in cross section. As shown in FIG. 2, the bottom end of the front cover 12 is hinged to the apparatus main body 10 (reference numeral 12A denotes a hinge shaft which extends in the right-left direction (i.e., perpendicularly to the paper surface of FIG. 2)), whereby the front cover 12 is opened when it is rotated toward the front side and closed when it is rotated toward the rear side. The rear end of the top cover 13 is hinged to the apparatus main body 10 (reference numeral 13A denotes a hinge shaft which is parallel with the hinge shaft 12A), whereby the top cover 13 is opened when it is rotated upward and closed when it is rotated downward.

As shown in FIG. 2, a sheet housing unit 14 for housing a number of stacked sheets P occupies a bottom portion of the apparatus main body 10. A sheet P to be subjected to printing is picked up from the sheet housing unit 14, goes up along a sheet conveyance path 20 which is formed in a front portion of the apparatus main body 10, and is ejected to an ejected sheet tray 15 which is a top portion of the top cover 13.

As shown in FIG. 2, in the printer 1 which is a tandem full-color printer, the apparatus main body 10 incorporates a transfer belt 31 which is rotatable (rotates in the direction indicated by arrow A) and is stretched so as to be inclined with its front side down (as viewed in FIG. 2, with its left side down), four-color image forming units 4Y, 4M, 4C, and 4K which are juxtaposed under the transfer belt 31, a secondary transfer unit 23, a fusing unit 24, etc. The image forming units 4Y, 4M, 4C, and 4K are arranged parallel with the inclination direction of the transfer belt 31.

The four image forming units 4Y, 4M, 4C, and 4K serve to form toner images of yellow (Y), magenta (M), cyan (C), and black (K), respectively, and the same basic configuration. Each of the image forming units 4Y, 4M, 4C, and 4K is equipped with a developing device 5 and a photoreceptor unit 40 having a photoreceptor drum 41 as a main component. The photoreceptor unit 40 is set in the apparatus main body 10 so as to be able to be detached from above, and the developing device 5 is fixed to the apparatus main body 10.

An image exposing device 6 which is common to the image forming units 4Y, 4M, 4C, and 4K is disposed under the image forming units 4Y, 4M, 4C, and 4K. The image exposing device 6 is equipped with four semiconductor lasers (not shown) which emit laser beams that are modulated according to image data of Y, M, C, and K, respectively.

Color image information is input to the printer 1 from a personal computer or the like. When color image information is input to the printer 1, four laser beams corresponding to the respective colors are emitted from the semiconductor lasers of the image exposing device 6. The laser beams are deflected by a polygon mirror and then pass through or reflected by lenses and mirrors (not shown), and the surfaces of the rotating, charged photoreceptor drums 41 of the image forming units 4Y, 4M, 4C, and 4K are scanned with the respective laser beams. As a result, electrostatic latent images of the respective colors are formed on the photoreceptor drums 41.

The electrostatic latent images formed on the photoreceptor drums 41 are developed with developers containing toners of the respective colors by means of the developing devices 5, and resulting toner images (color images) are transferred primarily to the outer circumferential surface of the rotating transfer belt 31 by primary transfer rollers 32. The primary transfer operations of transferring the toner images from the photoreceptor drums 41 to the transfer belt 31 are performed in order with prescribed timing in the respective image forming units 4Y, 4M, 4C, and 4K. A full-color toner image is formed on the outer circumferential surface of the transfer belt 31 when the region concerned of the transfer belt 31 has passed the most downstream, black image forming unit 4K.

Attached to the top cover 13 (see FIGS. 3 and 4), the transfer belt 31 is opposed to the image forming units 4Y, 4M, 4C, and 4K (see FIG. 2) when the top cover 13 is closed. And the primary transfer rollers 32 are disposed at such positions as to form nip regions between themselves and the photoreceptor drums 41 with the transfer belt 31 interposed in between. The transfer belt 31 is wound on a drive roller 33, a follower roller 34, and a tension roller 35 and is rotated in the direction indicated by arrow A when the drive roller 33 is rotated.

Referring to FIG. 2, the full-color toner image formed on the transfer belt 31 is transferred in the secondary transfer unit 23 to a sheet P that is elevated along the sheet conveyance path 20 with proper timing after being drawn out of the sheet housing unit 14 by a sheet feed unit 21. The sheet feed unit 21 is equipped with a sheet feed roller 21*a* and a sheet separation roller 21*b*. Sheets P are separated into individual sheets by the sheet feed unit 21, and each sheet P is conveyed to a registration roller pair 22 and stopped there. The sheet P is then sent to the secondary transfer unit 23 by the registration roller pair 22 which is rotationally driven with prescribed timing. The secondary transfer unit 23 is equipped with the above-mentioned drive roller 33 (on which the transfer belt 31 is wound) and a secondary transfer roller 23*a* which forms a nip region together with the drive roller 33. The full-color toner image is transferred from the transfer belt 31 to the sheet P when the sheet P passes between the rollers 33 and 23*a*.

The sheet P to which the full-color toner image has been transferred passes through the fusing unit 24, whereby the color toner image is fused on the sheet P. The fusing unit 24 is equipped with a heat roller 24*a* and a pressure roller 24*b* which forms a nip region together with the heat roller 24*a*. The full-color toner image is fused on the sheet P through pressure contact and heating when the sheet P passes between the rollers 24*a* and 24*b*. The sheet P that has passed through the fusing unit 24 is ejected to the ejected sheet tray 15 by a sheet ejection roller pair 25. The sheet conveyance path 20 is a path that extends from the sheet feed unit 21 to the sheet ejection roller pair 25 via the registration roller pair 22, the secondary transfer unit 23, and the fusing unit 24.

A sheet flipping mechanism 26 for flipping a sheet P is disposed in front of the sheet conveyance path 20. As shown in FIG. 4, the sheet flipping mechanism 26 is attached to the front cover 12. As shown in FIG. 4, the secondary transfer roller 23*a* of the secondary transfer unit 23, the fusing unit 24, and the sheet ejection roller pair 25 which form the sheet conveyance path 20 are supported by the front cover 12 and rotated together with the front cover 12.

(2) Configuration of Photoreceptor Unit

Next, the photoreceptor unit 40 according to the embodiment will be described in detail.

Figure 5:
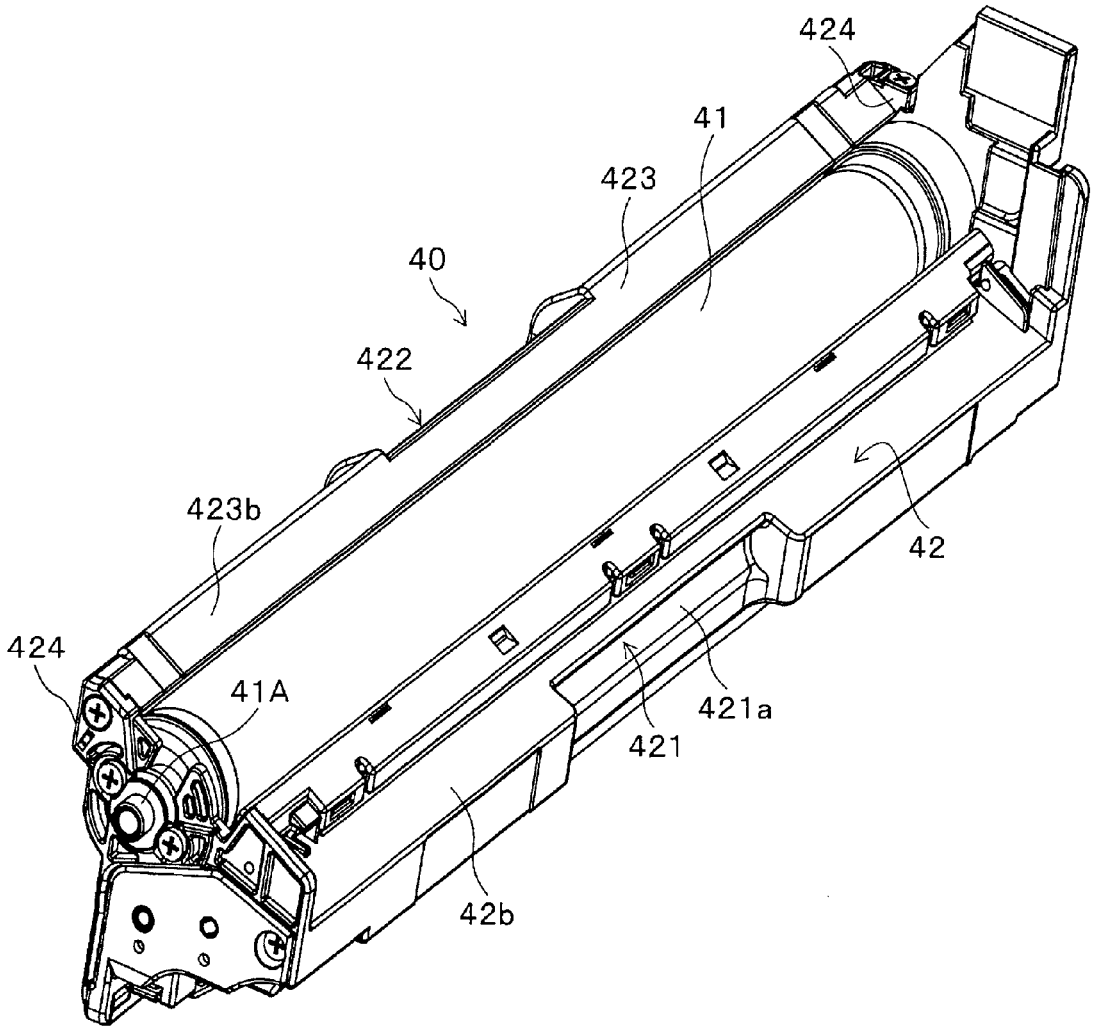
FIG. 5 is a perspective view of a photoreceptor unit according to the embodiment.
Figure 6:
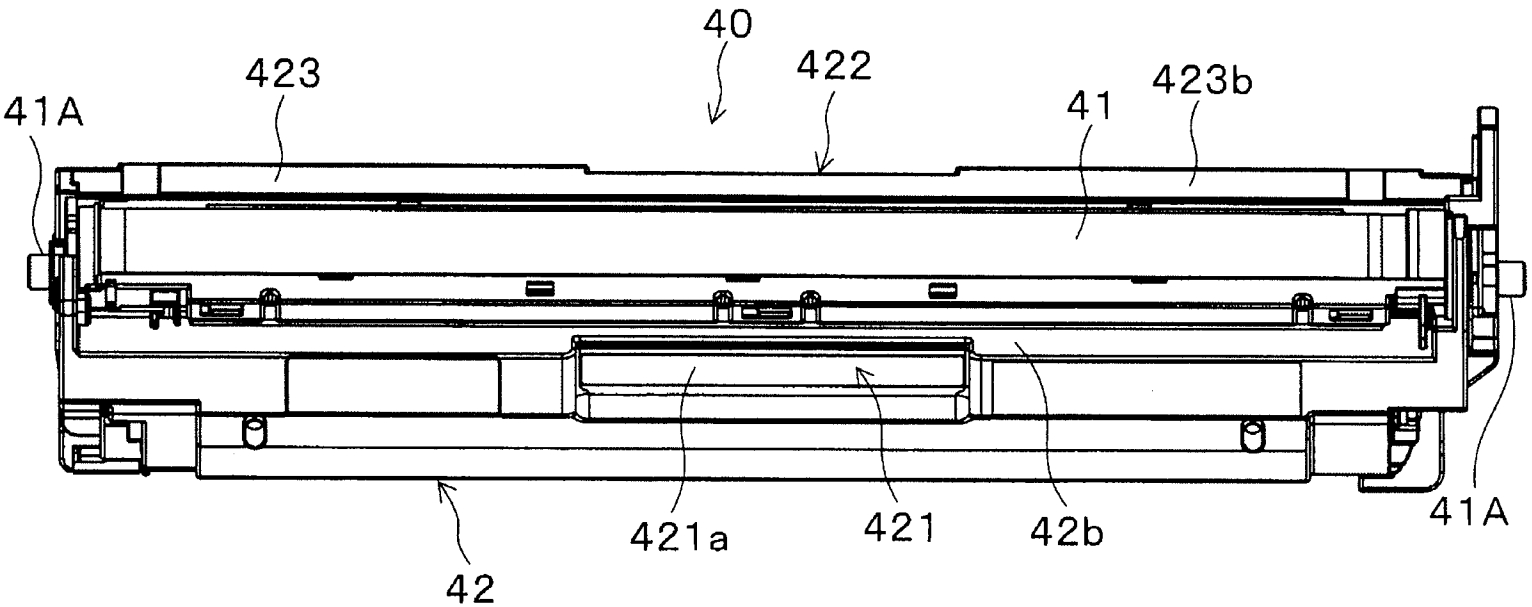
FIG. 6 is a front view of the photoreceptor unit.
Figure 7:
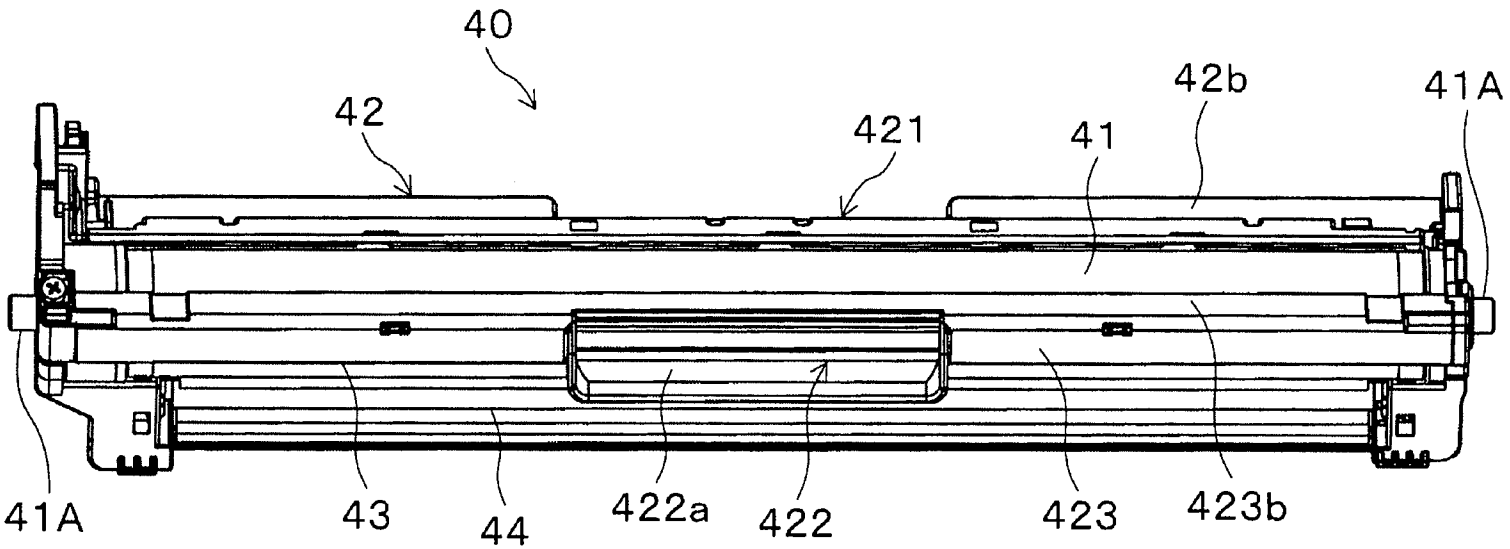
FIG. 7 is a rear view of the photoreceptor unit.
Figure 8:
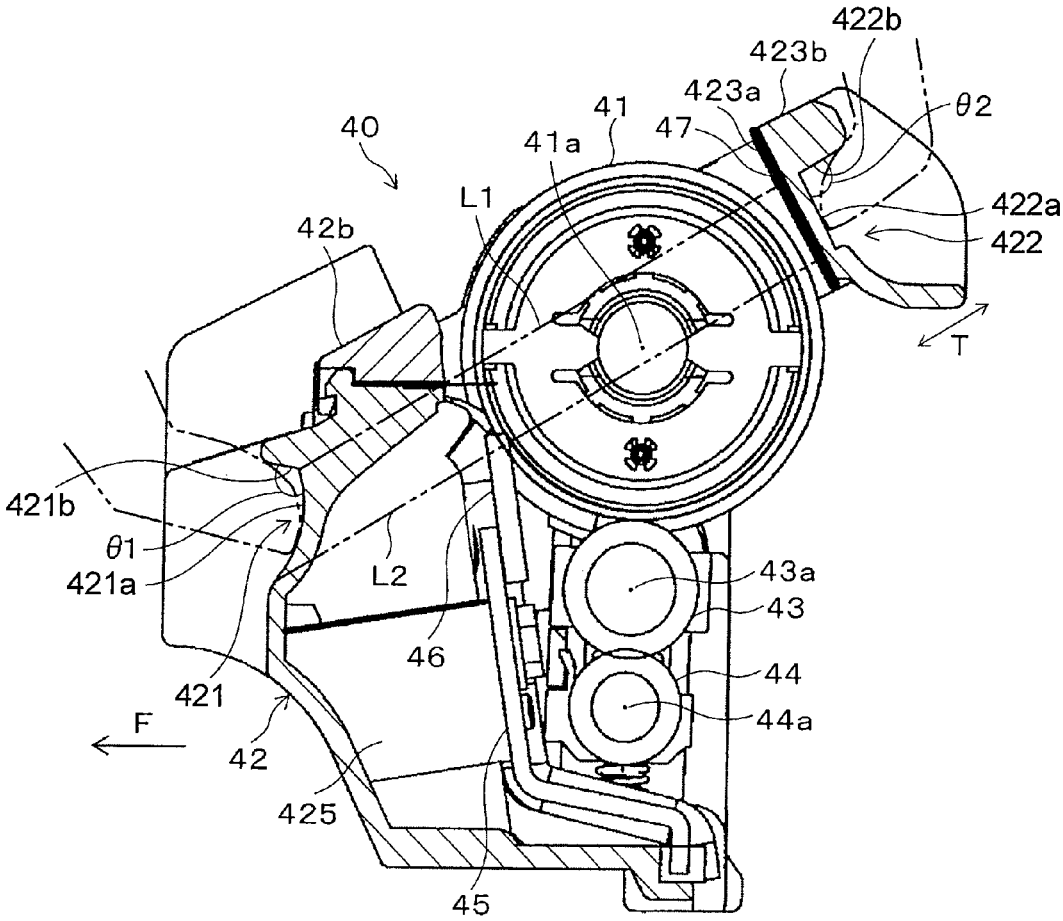
FIG. 8 is a sectional view of the photoreceptor unit.

FIGS. 5-7 show the whole of the photoreceptor unit 40, and FIG. 8 is a sectional view showing how the photoreceptor unit 40 is set in the apparatus main body 10 (arrow F indicates the front side). The outward form of the photoreceptor unit 40 is generally formed by a case-shaped support body (attachment body) 42 and the photoreceptor drum 41, and the support body 42 is shaped so that it can be set in the apparatus main body 10. In the following description, the directions such as the front-rear direction and the top-bottom directions are ones in a state that the photoreceptor unit 40 is set in the apparatus main body 10.

As shown in FIG. 8, the photoreceptor drum 41 occupies a top-rear space of the support body 42 and is supported rotatably via rotary shafts 41A provided on both sides. A charging roller 43 for charging the surface of the photoreceptor drum 41 and a charge removing roller 44 for removing charge from the charged charging roller 43 are disposed under the photoreceptor drum 41. The charging roller 43 and the charge removing roller 44 are supported rotatably by the support body 42 via rotary shafts (not shown) so as to be in contact with the bottom of the outer circumferential surface of the photoreceptor drum 41 and the bottom of the outer circumferential surface of the charging roller 43, respectively. In a state that the photoreceptor unit 40 is set in the apparatus main body 10, the axes 43*a* and 44*a* of the rotary shafts of the charging roller 43 and the charge removing roller and the axis 41*a* of the photoreceptor drum 41 are approximately on the same vertical line.

As shown in FIG. 8, the support body 42 incorporates a frame 45 which is formed by sheet metal working. A cleaning blade 46 for removing toner that remains on (stuck to) the surface of the photoreceptor drum 41 by scraping it off is fixed to the top of the frame 45. A waste toner room 425 for storing toner that is scraped off by the cleaning blade 46 and drops down is formed in front of the frame 45 in the support body 42.

The support body 42 has a first gripping portion 421 and a second gripping portion 422 which are used for attaching or detaching the photoreceptor unit 40 to or from the apparatus main body 10 by gripping the entire photoreceptor unit 40. The first gripping portion 421 is a recess which is formed in the support body 42 on the front side at the center in the longitudinal direction. That is, the first gripping portion 421 is formed in front of, obliquely below the photoreceptor drum 41. As shown in FIG. 8, the first gripping portion 421 is formed with an approximately vertical gripping surface 421*a* and a finger hooking surface 421*b* which extends forward from the top of the gripping surface 421*a*. The angle θ1 formed by the gripping surface 421*a* and the finger hooking surface 421*b* is about 90° (e.g., 80° to 100°).

On the other hand, the second gripping portion 422 is formed in a plate 423 which is disposed behind, obliquely above the photoreceptor drum 41. As shown in FIG. 5, the plate 423 bridges stays 424 which are formed at the two respective ends of the support body 42 and two end portions of the plate 423 are fixed to the respective stays 424. The plate 423 has a top surface 423*b* and an inner surface 423*a* which is opposed to the outer circumferential surface of the photoreceptor drum 41 with a gap.

The second gripping portion 422 is a recess which is formed in the plate 423 on the rear side at the center in the longitudinal direction. That is, the second gripping portion 422 is formed somewhat above the axis 41*a* of the rotary shafts 41A. As shown in FIG. 8, the second gripping portion 422 is formed with a gripping surface 422*a* which is approximately parallel with the inner surface 423*a* and a finger hooking surface 422*b* which extends rearward (obliquely upward) from the top of the gripping surface 422*a*. As in the case of the first gripping portion 421, the angle θ2 formed by the gripping surface 422*a* and the finger hooking surface 422*b* is about 90° (e.g., 80° to 100°).

The plate 423 is made of an elastic material such as a resin which can warp in the thickness direction (i.e., in the direction indicated by arrow T in FIG. 8). When the second gripping portion 422 is pushed toward photoreceptor drum 41, the plate 423 is warped and its inner surface 423*a* comes into contact with the outer circumferential surface of the photoreceptor drum 41. At this time, a conductive protective sheet (protective member) 47 which is stuck to the inner surface 423*a* of the plate 423 comes into contact with the photoreceptor drum 41. The plate 423 is not warped in a state that the photoreceptor unit 40 is set in the apparatus main body 10 and a gap is secured between the inner surface 423*a* (i.e., protective sheet 47) and the photoreceptor drum 41.

The photoreceptor drum 41 is interposed between the first gripping portion 421 which is located in front of, obliquely below the photoreceptor drum 41 and the second gripping portion 422 which is located behind, obliquely above the photoreceptor drum 41. In other words, the first gripping portion 421 and the second gripping portion 422 are formed at such positions that the photoreceptor drum 41 is interposed between them. In this case, as shown in FIG. 8, the axis 41*a* of the rotary shafts 41A of the photoreceptor drum 41 exists between the straight lines L1 and L2 that connect the ends of the gripping surfaces 421*a* and 422*a* of the first gripping portion 421 and the second gripping portion 422. A top portion of the photoreceptor drum 41 is exposed so as to project from the plane defined by a top surface 42*b* of the support body 42 and the top surface 423*b* of the plate 423. The top surfaces 42*b* and 423*b* exist in the same plane that is inclined in such a manner that the front side is lower. The second gripping portion 422 is lower than the first gripping portion 421 according to the inclination of the plate defined by the top surfaces 42*b* and 423*b*.

As shown in FIG. 8, the photoreceptor drum 41 can be inserted into or removed from the apparatus main body 10 by gripping the photoreceptor unit 40 by inserting the thumb into the first gripping portion 421 and inserting the other fingers into the second gripping portion 422. That is, the photoreceptor unit 40 can be gripped with the photoreceptor drum 41 put between the thumb and the other fingers using the first gripping portion 421 and the second gripping portion 422. The fingers can be hooked reliably on the first gripping portion 421 and the second gripping portion 422 by bringing the finger tips into contact with the gripping surfaces 421*a* and 422*a* and bringing the cushions of the fingers into contact with the finger hooking surfaces 421*b* and 422*b*, whereby the photoreceptor unit 40 can be gripped without coming off the hand. When the photoreceptor unit 40 is gripped, the plate 423 is warped toward the photoreceptor drum 41 and the protective sheet 47 comes into contact with it.

As described above, in a state that the photoreceptor unit 40 is gripped, the photoreceptor drum 41 is put between the thumb and the other fingers using the first gripping portion 421 and the second gripping portion 422 and the axis 41*a* (one form of a center of rotation; in the embodiment, the center of gravity) of the shafts 41A of the photoreceptor drum 41 exists between the straight lines connecting the ends of the gripping surfaces 421*a* and 422*a* of the gripping portions 421 and 422 (in a sectional view). Since the charging roller 43 and the charge removing roller 44 are located under the mid point between the gripping portions 421 and 422, the center of gravity of the entire photoreceptor unit 40 is not deviated to either side and hence the photoreceptor unit 40 can be gripped in a well-balanced manner. In addition, since the finger hooking surfaces 421*b* and 422*b* of the gripping portions 421 and 422 form angles of about 90° with the gripping surfaces 421*a* and 422*a*, respectively, the fingers are hooked on the finger hooking surfaces 421*b* and 422*b* reliably.

Therefore, the photoreceptor unit 40 can be moved while being gripped stably without being coming off the hand, as a result of which it can be inserted into or removed from the apparatus main body 10 smoothly. In a state that the photoreceptor unit 40 is set in the apparatus main body 10, the plane that is defined by the top surfaces 42*b* and 423*b* of the support body 42 and the plate 423 is inclined in such a manner that the front side is lower. This facilitates insertion of the fingers into the gripping portions 421 and 422 and hence contributes to the smooth insertion and removal of the photoreceptor unit 40, too.

Although the plate 423 is warped toward the photoreceptor drum 41 when pushed via the second gripping portion 422, it does not come into direct contact with the photoreceptor drum 41. Instead, the protective sheet 47 which is stuck to the plate 423 comes into contact with the photoreceptor drum 41 and pushes it. The protective sheet 47 prevents formation of a scratch on the photoreceptor drum 41. Being conductive, the protective sheet 47 prevents the photoreceptor drum 41 from being charged through friction between them. This prevents an electrostatic memory phenomenon that a positive charging history item remains on the surface of the photoreceptor drum 41 and streaks occur at the time of printing.

Where unlike in the embodiment a photoreceptor unit is gripped using gripping portions that are distant from a photoreceptor drum, the size of the photoreceptor unit is increased. Furthermore, since a portion that is distant from the center of gravity is gripped, the gripping portions receive a heavy load and hence tend to be deformed. To prevent such deformation, the gripping portions are required to be strong. This configuration is thus associated with a problem that the photoreceptor unit is increased in weight and cost. In contrast, in the embodiment, since the photoreceptor unit 40 is gripped with the photoreceptor drum 41 interposed between the first gripping portion 421 and the second gripping portion 422, the gripping portions 421 and 422 need not be strong and hence the photoreceptor unit 40 is reduced in size and cost.

Although in the embodiment the axis 41*a* of the rotary shafts 41A of the photoreceptor drum 41 exists between the lines that connect the ends of the gripping surfaces 421*a* and 422*a* of the first gripping portion 421 and the second gripping portion 422, the axis 41*a* may be located under that range. Even in this case, the photoreceptor unit 40 can be gripped stably because the center of gravity of the photoreceptor drum 41 is located under the gripping surfaces 421*a* and 422*a*.

Although in the embodiment the photoreceptor unit 40 is set from above in a detachable manner in a state that the top portion of the apparatus main body 10 is opened, the invention is not limited to such a case. The invention can be applied in various manners as appropriate according to forms of image forming apparatus such as a form in which the user grips a photoreceptor unit and attaches or detaches it to or from the front side, right side, or left side in a state that a front portion, a right portion, or a left portion, for example, of an apparatus main body is opened and a form in which the user pulls out a photoreceptor unit from the front side, right side, or left side in the longitudinal direction of the photoreceptor unit and then grips the photoreceptor unit and detaches it in a state that a front portion, a right portion, or a left portion, for example, of an apparatus main body is opened.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A photoreceptor unit of an image forming apparatus comprising:

an attachment body that is attached to the image forming apparatus and is detachable from the image forming apparatus;

a photoreceptor body that is rotatably provided in the attachment body;

a first gripping portion that is provided in the attachment body; and a second gripping portion that is provided in the attachment body and is contactable with the photoreceptor body when the photoreceptor unit is gripped, the second gripping portion not contacting the photoreceptor body when the photoreceptor unit is attached to the image forming apparatus, wherein the photoreceptor body is provided between the first gripping portion and the second gripping portion and is allow to be gripped by using the first gripping portion and the second gripping portion.

2. The photoreceptor unit according to claim 1, wherein the first gripping portion includes a first gripping face, the second gripping portion includes a second gripping face, and when the photoreceptor unit is gripped using the first gripping portion and the second gripping portion to detach the photoreceptor unit from the image forming apparatus, a center of rotation of the photoreceptor body is located at a given region between two straight lines or under the given position, the straight lines are composed of a first line connecting an upper end of the first gripping face and an upper end of the second gripping face and a second line connecting a lower end of the first gripping face and a lower end of the second gripping face.

3. The photoreceptor unit according to claim 1, wherein the second gripping portion is provided with a protective member at least in a region for contact with the photoreceptor body.

4. The photoreceptor unit according to claim 2, wherein the second gripping portion is provided with a protective member at least in a region for contact with the photoreceptor body.

5. The photoreceptor unit according to claim 3, wherein the protective member is conductive.

6. The photoreceptor unit according to claim 4, wherein the protective member is conductive.

* * * * *